US006068649A

United States Patent [19]

Chamberlain

[11] Patent Number: 6,068,649

[45] Date of Patent: May 30, 2000

[54] PACIFIER SECURING SYSTEM

[76] Inventor: Constance Chamberlain, 14475 Maplewood St., Poway, Calif. 92064

[21] Appl. No.: 09/311,415

[22] Filed: May 13, 1999

[51] Int. Cl.[7] ..... A61J 17/00

[52] U.S. Cl. ..... 606/234; 128/207.11; 128/207.17

[58] Field of Search ..... 606/234–236; 128/206.13, 207.17, 207.11

[56] References Cited

U.S. PATENT DOCUMENTS 5,237,988 8/1993 McNeese ..... 128/207.17
5,513,633 5/1996 Islava ..... 128/207.17
5,819,731 10/1998 Dyrud et al. ..... 128/207.11

*Primary Examiner*—Gary Jackson
*Assistant Examiner*—William W. Lewis

[57] ABSTRACT

A pacifier securing system for securing positioning of a pacifier in an infant's mouth. The pacifier securing system includes a pacifier having an outwardly extending guard plate, apertures in opposite sides of the guard plate, and adjustable straps employing hook and loop fasteners to form loops for engaging the straps between the apertures in the guard plate and an infant's ears. The adjustable straps are further designed to permit attachment of the straps to each other around the infant's neck to secure the pacifier in the mouth of the infant.

8 Claims, 3 Drawing Sheets

PACIFIER SECURING SYSTEM

BACKGROUND OF THE INVENTION

1. Field of the Invention

The present invention relates to pacifiers and more particularly pertains to a new pacifier securing system for securing positioning of a pacifier in an infant's mouth.

2. Description of the Prior Art

The use of pacifiers is known in the prior art. More specifically, pacifiers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,969,894; 4,700,408; 2,834,350; 4,815,456; 3,392,729; and Des. 331,287.

While these devices fulfill their respective, particular objectives and requirements, the aforementioned patents do not disclose a new pacifier securing system. The inventive device includes a pacifier having an outwardly extending guard plate, apertures in opposite sides of the guard plate, and adjustable straps employing hook and loop fasteners to form loops for engaging the straps between the apertures in the guard plate and an infant's ears.

In these respects, the pacifier securing system according to the present invention substantially departs from the conventional concepts and designs of the prior art, and in so doing provides an apparatus primarily developed for the purpose of securing positioning of a pacifier in an infant's mouth.

SUMMARY OF THE INVENTION

In view of the foregoing disadvantages inherent in the known types of pacifiers now present in the prior art, the present invention provides a new pacifier securing system construction wherein the same can be utilized for securing positioning of a pacifier in an infant's mouth.

The general purpose of the present invention, which will be described subsequently in greater detail, is to provide a new pacifier securing system apparatus and method which has many of the advantages of the pacifiers mentioned heretofore and many novel features that result in a new pacifier securing system which is not anticipated, rendered obvious, suggested, or even implied by any of the prior art pacifiers, either alone or in any combination thereof.

To attain this, the present invention generally comprises a pacifier having an outwardly extending guard plate, apertures in opposite sides of the guard plate, and adjustable straps employing hook and loop fasteners to form loops for engaging the straps between the apertures in the guard plate and an infant's ears.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pacifier securing system apparatus and method which has many of the advantages of the pacifiers mentioned heretofore and many novel features that result in a new pacifier securing system which is not anticipated, rendered obvious, suggested, or even implied by any of the prior art pacifiers, either alone or in any combination thereof.

It is another object of the present invention to provide a new pacifier securing system that may be easily and efficiently manufactured and marketed.

It is a further object of the present invention to provide a new pacifier securing system that is of a durable and reliable construction.

An even further object of the present invention is to provide a new pacifier securing system which is susceptible of a low cost of manufacture with regard to both materials and labor, and which accordingly is then susceptible of low prices of sale to the consuming public, thereby making such pacifier securing system economically available to the buying public.

Still yet another object of the present invention is to provide a new pacifier securing system which provides in the apparatuses and methods of the prior art some of the advantages thereof, while simultaneously overcoming some of the disadvantages normally associated therewith.

Still another object of the present invention is to provide a new pacifier securing system for securing positioning of a pacifier in an infant's mouth.

Yet another object of the present invention is to provide a new pacifier securing system which includes a pacifier having an outwardly extending guard plate, apertures in opposite sides of the guard plate, and adjustable straps employing hook and loop fasteners to form loops for engaging the straps between the apertures in the guard plate and an infant's ears.

Still yet another object of the present invention is to provide a new pacifier securing system that facilitates securement of a pacifier in the mouth of an infant using straps that are either attachable to each other around a neck of the infant or engageable to themselves to form loops for positioning around the infant's ears.

Even still another object of the present invention is to provide a new pacifier securing system that holds a pacifier in the mouth of an infant to prevent accidental dropping and subsequent desanitization of the pacifier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
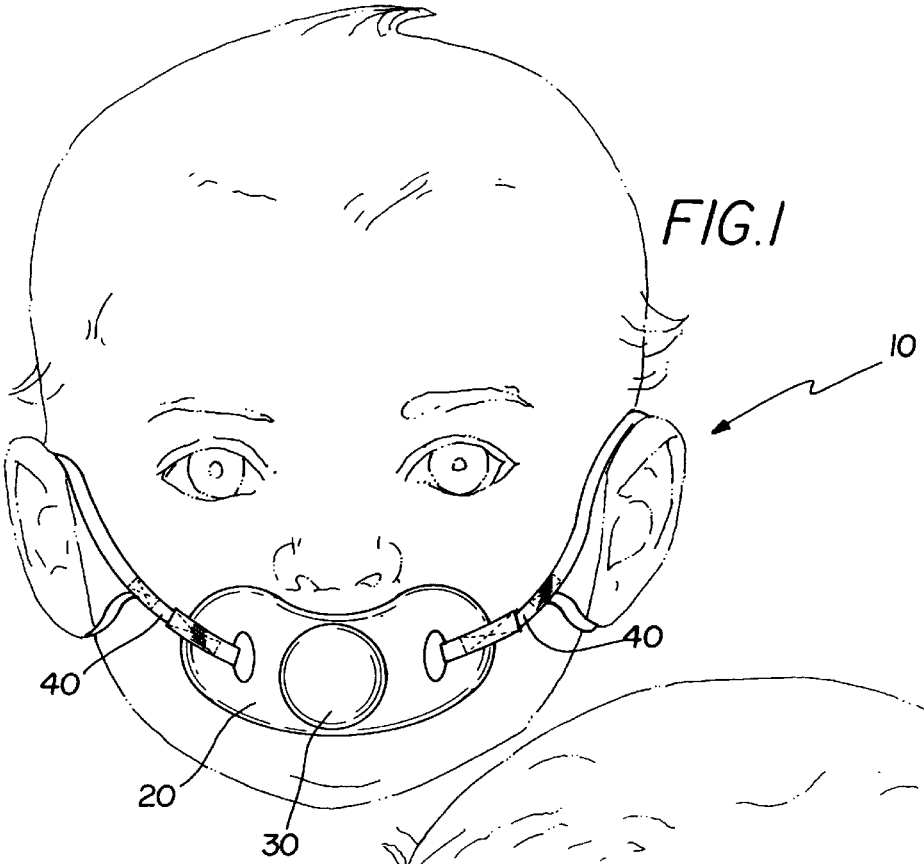
FIG. 1 is a front view of a new pacifier securing system according to the present invention.
Figure 2:
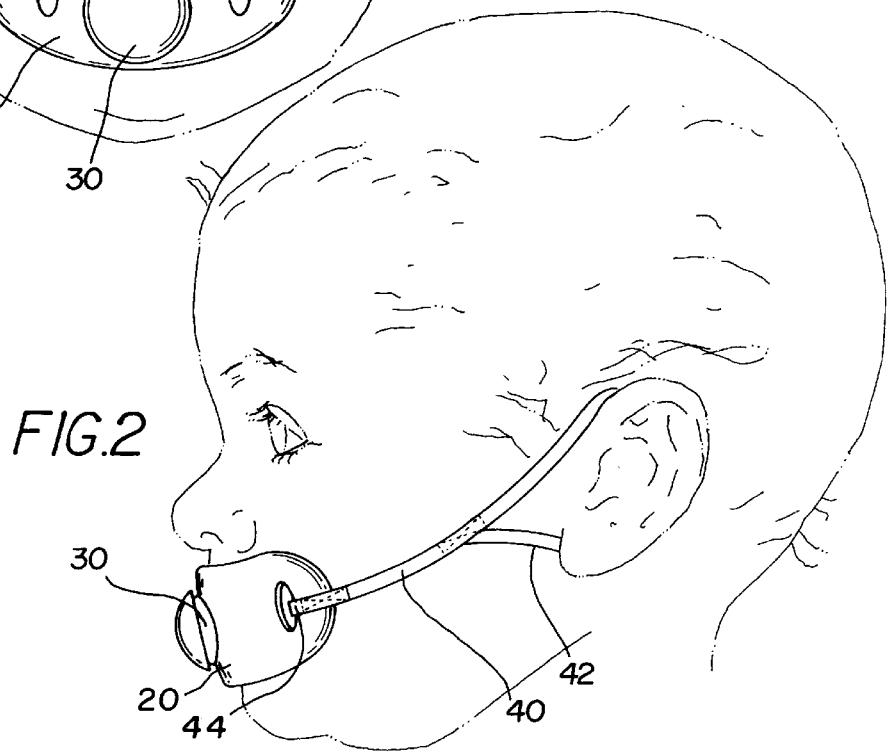
FIG. 2 is a side view of the present invention.
Figure 3:
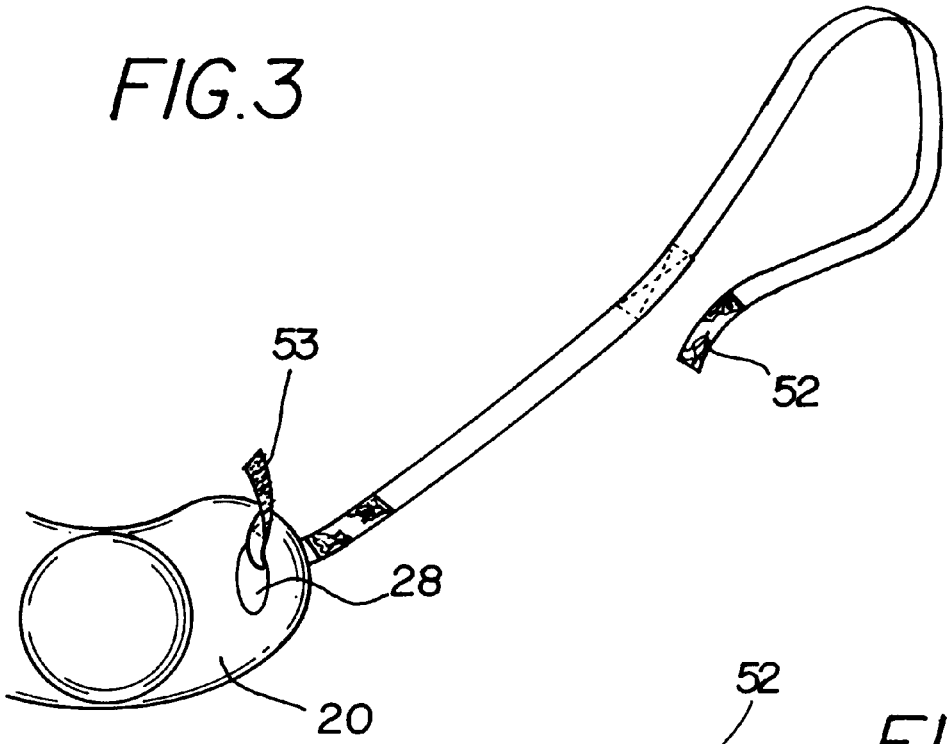
FIG. 3 is a perspective view of the straps of the present invention.
Figure 4:
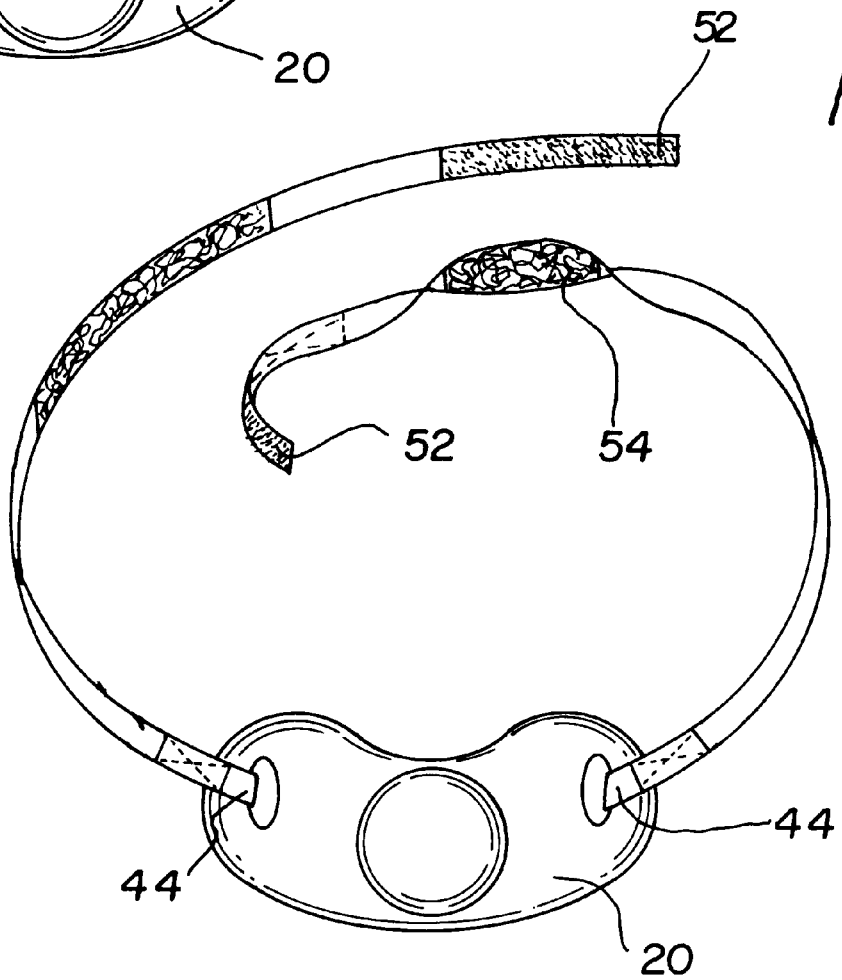
FIG. 4 is a perspective view of the alternate fastening arrangement of the present invention.
Figure 5:
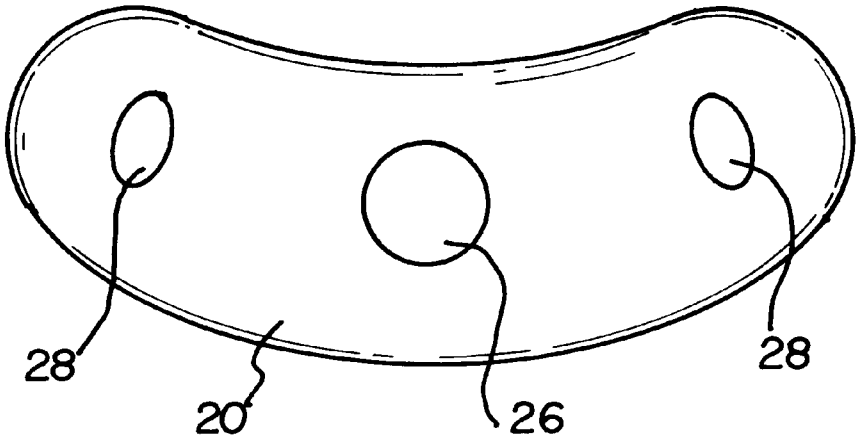
FIG. 5 is a front view of the guard plate view of the present invention.
Figure 6:
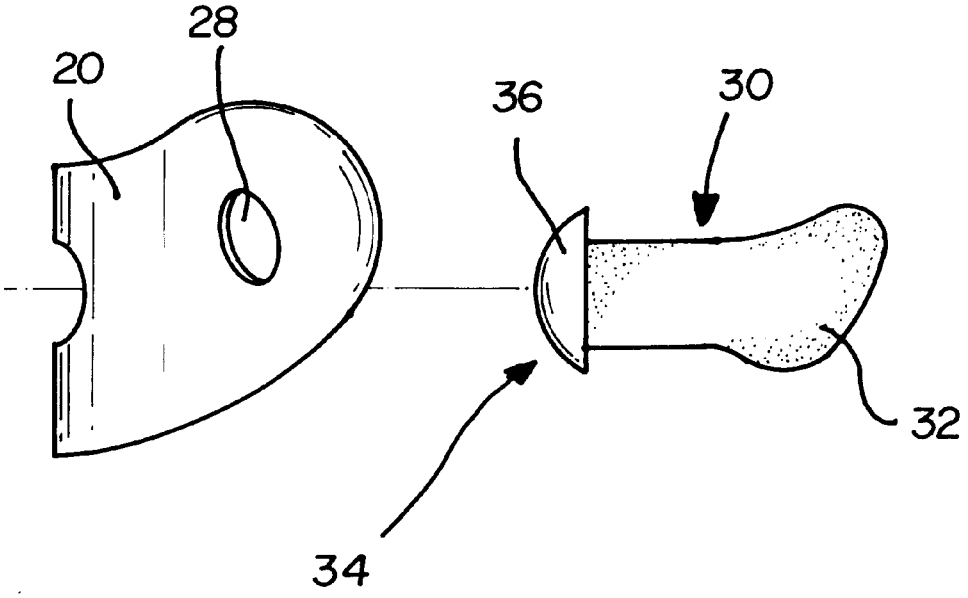
FIG. 6 is a side view of the nipple and guard plate of the present invention.

With reference now to the drawings, and in particular to FIGS. 1 through 6 thereof, a new pacifier securing system embodying the principles and concepts of the present invention and generally designated by the reference numeral 10 will be described.

As best illustrated in FIGS. 1 through 6, the pacifier securing system 10 generally comprises a pacifier 12 including an outwardly extending guard plate 20, a nipple 30, and adjustable straps 40 including hook and loop fasteners 50 for forming loops 42 and 44 at opposite ends of each strap 40.

The guard plate 20 of the pacifier 12 is generally concave such that opposite ends 24 of the guard plate 20 are curved inwardly towards the nipple 30. The guard plate 20 is also generally arcuate such that the opposite ends 24 are turned upwardly when the pacifier 12 is inserted into the mouth of the infant. The guard plate 20 further includes a central opening 26 and is structured to include apertures 28 on each side of the central opening 26.

The nipple 30 is designed for insertion into the mouth of the infant. The nipple 30 includes a nipple end 32 and a connection end 34. The connection end 34 is designed for inserting through the central opening 26 in the guard plate 20. The connection end 34 includes a flexible stopper 36 insertable through the central opening 26 in the guard plate 20 for releasably engaging the nipple 30 to the guard plate 20.

The adjustable straps 40 include hook and loop fasteners 50 for forming loops 42 and 44 at opposite ends of each strap 40. A first loop 42 in each strap 40 is engageable to a respective one of the apertures 28 in the guard plate 20. The second loop 44 in each strap 40 is designed for engagement around a respective ear of the infant when the pacifier 12 is positioned in the infant's mouth.

Although the positioning of the hook and loop fasteners 50 is variable as long as the fasteners 50 are positioned to engage each other to form the loops 42 and 44, the preferred arrangement requires each strap 40 to include a first hook portion 52 coupled to a first end of the strap 40. A first loop portion 54 is coupled to the strap 40 in spaced relationship to the first hook portion 52 to form the first loop 42 when the first hook portion 52 is engaged to the first loop portion 54.

Each strap 40 also includes a second hook portion 53 coupled to a second end of the strap 40 and a second loop portion 55 spaced from the second hook portion 53 to form the second loop 44. The second loop 44 is designed for engagement through a respective aperture 28 in the guard plate 20 when the second hook portion 53 is engaged to the second loop portion 55.

It is most preferred that the first end of both straps 40 include a first hook portion 52. Thus the first hook portion 52 is positionable to engage the first loop portion 54 of the other strap 40 such that the straps are extendable around a neck of the infant to hold the pacifier securely in the infant's mouth.

For maximum adjustability and comfort, the hook portions 52 are positioned at the end of the straps 40 while the loop portions 54 are positioned in a spaced relationship from the hook portions 52. Thus the loop portions 54, which are less abrasive to the infant's skin, may comfortably extend along a length of the strap 40 to allow the hook portion 52 to attach at various points along the length of the strap 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pacifier and pacifier securing system comprising:

a pacifier having an outwardly extending guard plate;

said guard plate being structured to include apertures in opposite sides of the guard plate; and adjustable straps including hook and loop fasteners for forming loops at opposite ends of each strap, wherein a first one of said loops in each strap is engageable to a respective one of said apertures in said guard plate and an opposite loop in each strap is adapted for engagement around a respective ear of an infant when said pacifier is positioned in a mouth of the infant whereby said pacifier is secured within the mouth of the infant.

2. The pacifier and pacifier securing system of claim 1 further comprising:

each strap having one of a first hook portion and a first loop portion coupled to a first end thereof, each strap further having the other of said first hook portion and said first loop portion positioned proximate said first end, said first hook and first loop portions being spaced to form a first loop adapted for encircling the ear of the infant when said first hook portion is engaged to said first loop portion; and each strap having one of a second hook portion and a second loop portion coupled to a second end thereof, each strap further having the other of said second hook portion and said second loop portion positioned proximate said second end, said second hook and second loop portions being spaced to form a second loop for engagement through said respective aperture in said guard plate when said second hook portion is engaged to said second loop portion whereby said strap is engaged to said guard plate.

3. The pacifier and pacifier securing system of claim 2 further comprising:

said first hook and loop portions of a first one of said adjustable straps further being positionable to engage said first hook and loop portions of a second one of said adjustable straps such that said first and second straps are adapted to be engageable to each other around a neck of the infant whereby the pacifier is secured in the infant's mouth.

4. The pacifier and pacifier securing system of claim 2, further comprising:

said pacifier including a removable nipple adapted for insertion into the mouth of the infant.

5. The pacifier and pacifier securing system of claim 4, further comprising:

said guard plate being generally concave such that said opposite ends are curved inwardly towards said nipple.

6. The pacifier and pacifier securing system of claim 4, further comprising:

said guard plate having a generally arcuate shape such that said opposite ends are turned upwardly when said pacifier is inserted into the mouth of the infant.

7. The pacifier and pacifier securing system of claim 4, further comprising:

said guard plate including a central opening therein; and said nipple including a nipple end and a connection end, said connection end being for inserting through said central opening in said guard plate, said connection end including a flexible stopper insertable through said central opening in said guard plate for releasably engaging said nipple to said guard plate.

8. A pacifier and pacifier securing system comprising:

a pacifier having an outwardly extending guard plate;

said guard plate being structured to include apertures in opposite sides of the guard plate;

adjustable straps including hook and loop fasteners for forming loops at opposite ends of each strap, wherein a first one of said loops in each strap is engageable to a respective one of said apertures in said guard plate and an opposite loop in each strap is adapted for engagement around a respective ear of an infant when said pacifier is positioned in a mouth of the infant whereby said pacifier is secured within the mouth of the infant;

each strap having one of a first hook portion and a first loop portion coupled to a first end thereof, each strap further having the other of said first hook portion and said first loop portion positioned proximate said first end, said first hook and first loop portions being spaced to form a first loop adapted for encircling the ear of the infant when said first hook portion is engaged to said first loop portion;

each strap having one of a second hook portion and a second loop portion coupled to a second end thereof, each strap further having the other of said second hook portion and said second loop portion positioned proximate said second end, said second hook and second loop portions being spaced to form a second loop for engagement through said respective aperture in said guard plate when said second hook portion is engaged to said second loop portion whereby said strap is engaged to said guard plate;

said first hook and loop portions of a first one of said adjustable straps further being positionable to engage said first hook and loop portions of a second one of said adjustable straps such that said first and second straps are adapted to be engageable to each other around a neck of the infant whereby the pacifier is secured in the infant's mouth;

said pacifier including a removable nipple adapted for insertion into the mouth of the infant;

said guard plate being generally concave such that said opposite ends are curved inwardly towards said nipple;

said guard plate having a generally arcuate shape such that said opposite ends are turned upwardly when said pacifier is inserted into the mouth of the infant;

said guard plate including a central opening therein; and said nipple including a nipple end and a connection end, said connection end being for inserting through said central opening in said guard plate, said connection end including a flexible stopper insertable through said central opening in said guard plate for releasably engaging said nipple to said guard plate.

* * * * *